US008235374B2

(12) United States Patent
Keller

(10) Patent No.: US 8,235,374 B2
(45) Date of Patent: Aug. 7, 2012

(54) INSERTION APPARATUS AND INSERTION METHOD

(75) Inventor: Martin Keller, Turbenthal ZH (CH)

(73) Assignee: Ferag AG, Hinwil (CH)

( * ) Notice: Subject to any disclaimer, the term of this patent is extended or adjusted under 35 U.S.C. 154(b) by 28 days.

(21) Appl. No.: 12/997,379

(22) PCT Filed: Jun. 9, 2009

(86) PCT No.: PCT/CH2009/000187

§ 371 (c)(1),
(2), (4) Date: Jan. 6, 2011

(87) PCT Pub. No.: WO2009/149571

PCT Pub. Date: Dec. 17, 2009

(65) Prior Publication Data

US 2011/0109032 A1 May 12, 2011

(30) Foreign Application Priority Data

Jun. 11, 2008 (CH) ..... 0888/08

(51) Int. Cl.
*B65H 29/40* (2006.01)

(52) U.S. Cl. ..... 270/52.24; 270/52.25; 270/52.23; 270/52.19

(58) Field of Classification Search ..... 270/52.19, 270/52.2, 52.21, 52.22, 52.23, 52.24, 52.25, 270/60, 52.14
See application file for complete search history.

(56) References Cited

U.S. PATENT DOCUMENTS

| | | | | |
|---|---|---|---|---|
| 3,420,516 | A * | 1/1969 | Guggisberg | 270/52.2 |
| 3,450,400 | A * | 6/1969 | Guggisberg | 270/52.2 |
| 3,540,721 | A * | 11/1970 | Blowsky | 270/58.21 |
| 5,065,994 | A * | 11/1991 | Hatt | 270/52.23 |
| 5,556,087 | A * | 9/1996 | Gosslinghoff | 270/58.18 |
| 5,730,435 | A * | 3/1998 | Belanger et al. | 270/52.14 |
| 6,131,904 | A * | 10/2000 | Tomczak | 271/315 |
| 6,139,009 | A * | 10/2000 | Eckert | 271/187 |
| 7,571,902 | B2 * | 8/2009 | Carter et al. | 270/52.2 |
| 2011/0291345 | A1 * | 12/2011 | Silberbauer | 270/52.19 |

FOREIGN PATENT DOCUMENTS

| | | |
|---|---|---|
| DE | 1262298 | 3/1968 |
| DE | 1436585 | 10/1968 |
| FR | 1.323.844 | 4/1963 |
| JP | 6-321403 | 11/1994 |

* cited by examiner

*Primary Examiner* — Patrick Mackey
(74) *Attorney, Agent, or Firm* — Rankin, Hill & Clark LLP

(57) ABSTRACT

An apparatus for, and a method of, inserting flat articles, e.g. printed pre-products or additional products, parts of newspapers, goods samples, leaflets, fliers and other inserts, into folded printed products. Use is made of a rotary system with compartments which run along a closed circular rotary path and are oriented as a tangent or secant to the rotary path (U). This makes it possible for the printed products and the articles to be fed in the direction of rotation, as a result of which the forces acting on the products can be reduced. There are also advantages relating to format adaptation, since the opening angle of the product upon adjustment of the compartment base does not change to such a pronounced extent as is the case with radially oriented compartments.

20 Claims, 5 Drawing Sheets

INSERTION APPARATUS AND INSERTION METHOD

BACKGROUND OF THE INVENTION

1. Field of Invention

The invention lies in the field of the further processing of printed products and relates, in particular, to an apparatus and a method for inserting flat objects into a folded printed product, for example an envelope. Flat objects of this type are, for example, further printed products, printed preproducts or additional products, parts of newspapers, test samples, brochures, flyers and other inserts. The invention serves, for example, to produce a multiple part printed product.

2. Description of Related Art

In order to insert flat objects between the two product parts of a folded printed product, it is known to transfer the printed products coming from the rotary printing press to a separate apparatus, to hold it in the latter and to open it, to insert the flat objects and to remove the end product produced in this way and to convey it further. The apparatuses which have previously been used for this purpose, for example according to EP-A 0 588 764 or EP-A 1 090 867, comprise circulating systems with a plurality of compartments which are moved along a circular circulating track about a rotational axis by being arranged on a rigid rotational body, for example a wheel. The feed stations for the printed products and the objects to be inserted are arranged at the periphery of the circulating system. The printed products are introduced into the compartments with the fold at the front and are opened and held open by an opening device, with the result that the flat objects can be introduced into the opened product. The compartments are defined by dividing walls which extend in the substantially radial direction. The orientation of the compartments, that is to say the direction of an imaginary line or surface between two adjacent dividing walls, is radial. Inter alia, this makes a maximum large opening of the compartments possible, with the result that there are tolerances when the products are pushed in.

Similar apparatuses with substantially radially oriented compartments are known from documents FR-A 1 323 844, DE-B 12 62 298, U.S. Pat. No. 3,420,516 or DE-A 14 36 585.

However, a disadvantage of the known devices is the great accelerations which the products are subjected to during insertion into the compartments on account of the directional change between the feed direction and the direction of conveying in the circulating system. A further problem arises in the adaptation to different formats: the spacing between the two dividing walls varies to a very pronounced extent with the radius, on which the spacing is measured. Since the products are normally fixed in the compartments at their edges which lie radially on the outside, shorter products are spread open to a greater extent during opening than longer products and are therefore loaded undesirably in some circumstances. Finally, the compartments have to have a certain depth, in order for it to be possible to process products with a predefined maximum format. The radial orientation of the compartments leads here to comparatively large diameters of the system.

BRIEF SUMMARY OF THE INVENTION

The invention is therefore based on the object of specifying an apparatus and a method for inserting flat objects into folded printed products, which avoid the problems of the prior art. In particular, the products are to be treated gently; an adaptation to different formats is to be possible.

The invention proceeds from a prior art, as has been depicted in the introduction. The apparatus comprises a circulating system with a plurality of compartments which can be moved along a closed circular circulating track about a rotational axis, are delimited by dividing walls in the circulating direction and, along the circumference, have openings for inserting the printed products and the objects into the compartments. The circulating system is configured, for example, in the manner of a paddle wheel. There is a controllable opening device for opening and holding open the printed products which are inserted into the compartments at a first feed point with the folded edge at the front. The said controllable opening device is set up in such a way that the folded printed products are opened before a second feed point for the flat objects and are moved past this feed point in the opened state, with the result that the objects can be inserted into the open product. According to the invention, the dividing walls extend at least in regions substantially in the manner of a tangent or secant with respect to the circular circulating track. The compartments are therefore opened in a substantially tangential or secantial direction counter to the circulating direction and are preferably oriented, in particular, at an angle of less than 45° relative to the circulating track. Here, the circulating track is, for example, the track of those ends of the dividing walls which face the rotational axis, or the track of the compartment base. The latter is spaced apart from the rotational axis, in order that the compartments can be arranged in the described way. The direction of an imaginary line or surface between two adjacent dividing walls therefore extends substantially tangentially with respect to the circulating track or intersects the latter at a small angle.

If the circulating track is defined by the track of that point of the compartments, that is to say of the dividing walls or the compartment bases, which is at the smallest distance r from the rotational axis, the dividing walls preferably extend tangentially with respect to the circulating track defined in this way, in the immediate vicinity of the compartment base. The dividing walls are preferably bent toward the rotational axis in the region which faces away from the compartment base. The compartments preferably open counter to the circulating direction.

The method according to the invention provides for the printed products, and preferably also the objects, to be inserted to be fed in a direction which corresponds substantially to the orientation of the trailing dividing wall of the associated compartment when the latter is situated in the region of the corresponding feed point. Depending on the position of the second feed point, the object can also be introduced parallel to the leading dividing wall.

The invention makes it possible to feed the printed products in the direction of the compartments and first of all to convey them further without a significant directional change and therefore without great accelerations by rotation of the circulating system. The aerodynamic resistance of the printed product is reduced by the product being moved further with the folded edge at the front more or less in the direction of the product plane instead of perpendicularly with respect to the latter.

The invention has the further advantage that the spacing of the dividing walls does not change so much as a function of the depth of the compartment (from the periphery in the direction of the rotational axis) as in the case of radially oriented compartments. The problems depicted in the introduction with respect to format adaptation are therefore avoided.

A further advantage comprises the fact that the diameter of the circulating system for processing products with a predefined maximum format is reduced as a result of the orientation of the compartments which differs from the radial direction in comparison with those systems, in which the compartments are oriented radially, and the system according to the invention can therefore be of more compact configuration than the prior art.

This design of the circulating system with compartments arranged in an overlapping manner around the rotational center also leads to the products being conveyed within the circulating system in a very compact formation, which makes high conveying rates possible. The formation corresponds substantially to an imbricated formation which runs through a deflection point. The difference from a conventional imbricated formation lies in the fact that dividing walls are arranged between the products within the circulating system. The compartments are wound, as it were, around the rotational axis helically.

In order to feed the products substantially in the circulating direction or in the direction of the instantaneous orientation of the compartment, a feed station for the folded printed products is preferably arranged relative to the circulating system in such a way that the printed products are introduced substantially tangentially or secantially with respect to the circulating track, particularly preferably in the substantially horizontal direction.

It has been shown that dividing walls which are bent counter to the circulating direction and wind, for example, helically around the rotational axis have advantages, since they facilitate opening of the products. This is because, during fixing of one of the product parts against the bent dividing wall, the folded product normally spreads open without additional measures on account of its inherent rigidity. The opening device can therefore be realized in a simple way by a clamping element which presses one of the product parts against the dividing wall. As an alternative, the opening device can be realized by one or more vacuum nozzles in the dividing wall, as a result of which the adjacent product part is sucked against the dividing wall. Opening devices of this type which fix only one of the product parts can also be used in the case of straight compartment walls.

A bent dividing wall has the additional advantage that the space requirement (diameter of the apparatus) is reduced in comparison with the case with straight dividing walls.

The opening process is preferably assisted by further measures. Measures of this type can be the suitable arrangement of the different stations along the circulating track, which make it possible to use the positional change of the product during the transport along the circulating track and therefore to use gravity for opening. Furthermore, opening elements can be provided which can be pushed in between the product parts and raise the latter up from one another. Finally, the product parts can also be raised up from one another by blowing in air.

A control apparatus, by way of which the opening device can be controlled as a function of the position of the compartments along the circulating track, serves for the targeted receiving of a product and for the targeted release at a discharging position. This is realized, for example, by a stationary control track which interacts with driven elements which are arranged on the compartments.

For adaptation to different formats, displaceable stop elements are preferably provided which serve within the compartments as a stop for the folded edge and define the compartment base as a result. The stop elements are displaced, for example, in the radial direction, in order to support products of different format in such a way that the edge which lies opposite the folded edge is situated in the region of the compartment opening independently of the format.

In order to discharge the completed products to a removal device, a stripping device is preferably provided which pushes the products out of the compartments at a discharging position. The stripping device preferably acts on the folded edges. It is, in particular, stationary and moves the product on account of the relative movement between the stripping device and the circulating system. The stripping device can be adjustable for format adaptation.

BRIEF DESCRIPTION OF THE DRAWINGS

Examples of the invention are shown in the drawings and described in the following text. In the drawings, purely diagrammatically.

DETAILED DESCRIPTION OF THE INVENTION

Figure 1:
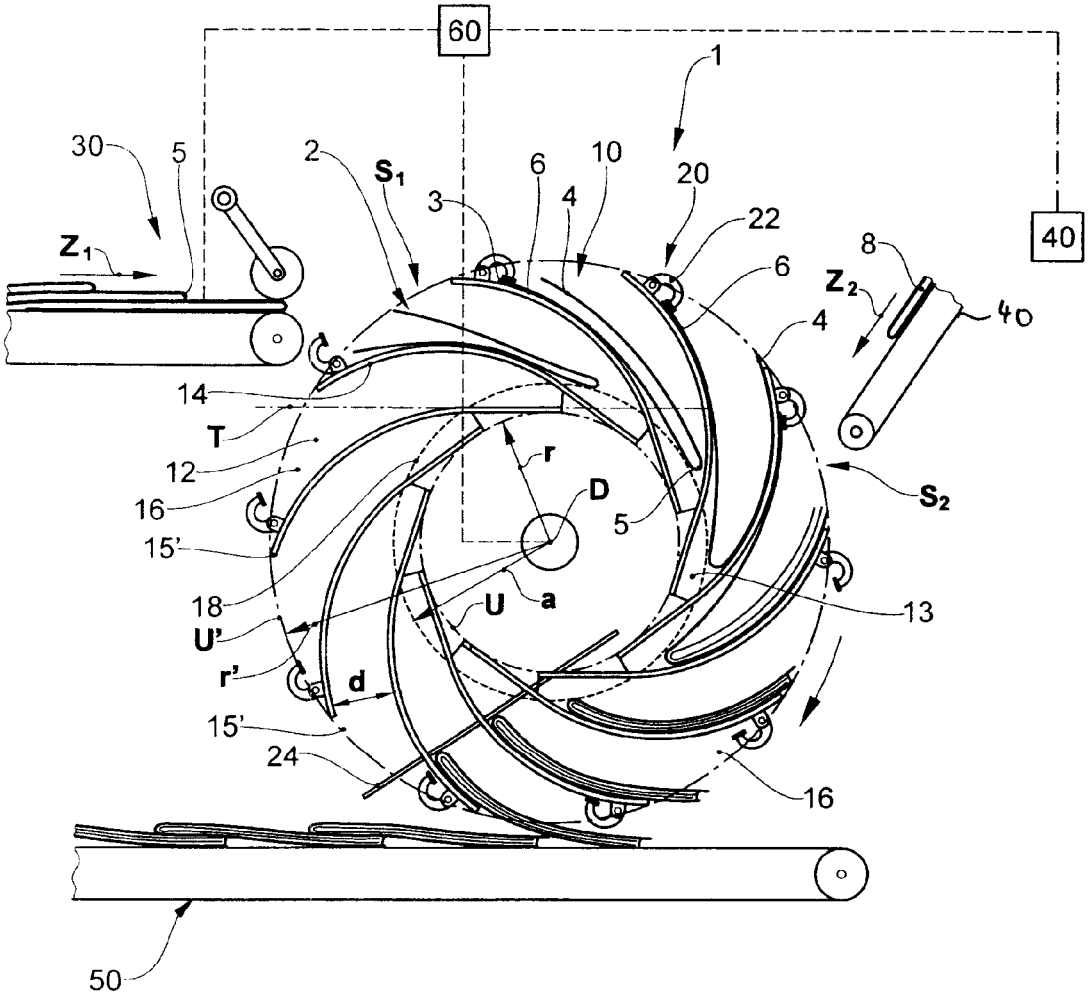
FIG. 1 shows an apparatus according to the invention for inserting flat objects into folded products.

FIG. 1 shows an inserting apparatus 1 with a circulating system 10 which comprises a plurality of compartments 12. In each case one compartment 12 is formed by two adjacent dividing walls 14. The dividing walls 14 have a continuous 2-dimensional surface or define a 2-dimensional surface. They are mounted on at least one rotational body (not shown here) so as to rotate about a rotational axis D. The dividing walls 14 define receiving pockets for products, which receiving pockets taper from the periphery of the circulating system 10 or the compartment opening 16 toward the compartment base 13.

As a result of the rotation about the rotational axis D which extends horizontally here, the compartments 12 describe a circular circulating track U with a radius r. In the present case, the circulating track U is denoted by the track of that dividing-wall end 15 which lies at the smallest distance r from the rotational axis D (r>0). If the track of another point on the dividing wall 14 is considered, for example that of the dividing-wall end 15' which lies on the outside, the corresponding circulating track U' lies concentrically with respect to the innermost circulating track U, but has a greater radius r'.

According to the invention, the compartments 12 and the dividing walls 14 are not oriented radially, as in the prior art, with respect to the rotational axis D and with respect to the circulating track U, U'. In the region of their end 15 which lies on the inside, the dividing walls 14 extend substantially tangentially with respect to the circulating track U with the smallest radius r which at the same time specifies the minimum distance of the compartment bases 13 from the rotational axis D. The corresponding tangent T is shown diagrammatically in the upper part of the circulating system 10 for one of the compartments 12. If a circulating track U' with a greater radius r' is considered, the dividing walls 14 extend secantially with respect to the circulating track U'. It is also possible that the dividing walls 14 extend secantially with respect to the inner circulating track U at as small an angle as possible The compartments 12 open counter to the circulating direction (in the clockwise direction here), that is to say the compartment opening 16 trails the compartment base 13.

Holding elements 22 which are part of an opening device 20 are arranged in the region of those ends 15' of the dividing walls 14 which lie radially on the outside. Said opening device 20 comprises, moreover, a control device (not shown here in greater detail) in the form of a control track and control elements which interact with the latter and by way of which the holding elements 22 can be moved between an open position and a clamping position.

Stop elements 18 which define an overall cylinder shell-shaped stop face for the folded edge 5 of the products are arranged in the region of the compartment base 13. The distance a of the stop elements 18 from the rotational axis D can preferably be adjusted for adaptation to different product formats, with the result that those edges of the products 2 which lie on the outside always assume the same position. A stripping device 24 for pushing the products 2 out of the compartments is situated in the lower region of the circulating track U. In the present case, the stripping device 24 is stationary, but could also comprise one or more revolving elements, for example a wheel, a cam belt or a gripper chain.

A feed station 30 for folded printed products 2 is arranged in the upper region of the circulating track U, on the left of its vertex here. Downstream of this, in the right hand part of the circulating track U, a feed station 40 is situated for objects 8 to be inserted into the products 2. Said objects 8 can be configured and assembled in different ways. A removal conveyor 50 for transporting away the products 2 with the inserted objects 8 is situated below the circulating system 10.

The rotation of the circulating system 10 and the product advancing of the feed stations 30, 40 are controlled by a common control device 60, preferably adapted to one another by the exchange of suitable control signals.

In the following text, the function of the insertion apparatus 1 will be described:

The folded products 2 are fed into the compartments 12 at a first feed point S1 by the feed station 30, in the closed state with the folded edge 5 at the front. During feeding, the products 2 are advanced in a substantially horizontal feed direction Z1 and are separated from the feed stream. The position of the feed point S1 is selected in such a way that the compartments 12 or the trailing dividing wall 14 of a compartment 12 have/has a likewise substantially horizontal orientation there. The products 2 therefore also, first of all, retain their original movement direction within the circulating system 10, with the result that large relative movements and high brake and frictional forces are avoided on the product 2.

Figure 7:
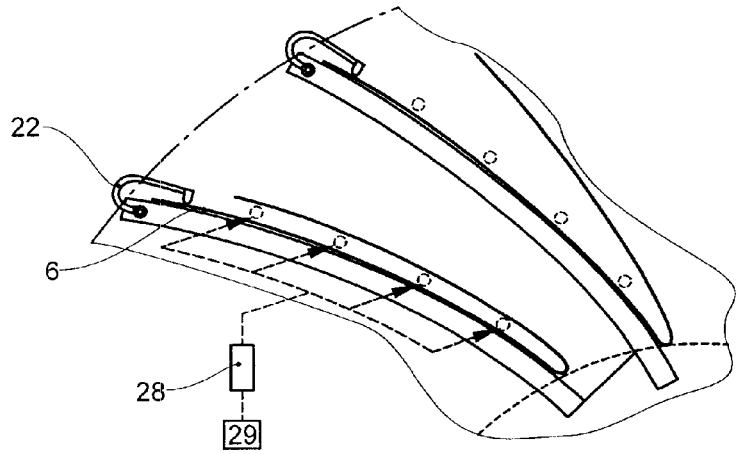

The products 2 comprise two product parts 4, 6 which are folded with the formation of a preliminary fold 3 on the trailing product part 6. In the closed state of the product 2, the preliminary fold 3 is clamped against the dividing wall 14 by the clamping element 22. During the rotation of the compartment 12 in the clockwise direction, the product 2 is moved in such a way that it is opened by gravity. As FIG. 7 shows, the opening operation can be assisted by blowing air. Here, the unheld product part 4 is supported by the leading dividing wall 14 of the compartment 12. In this situation, the flat object 8 is introduced into the opened product 2 at the second feed point S2. The feed direction Z2 of the objects 8 likewise coincides substantially with that orientation of the compartments 12 which exists at the feed point S2.

Figure 4:
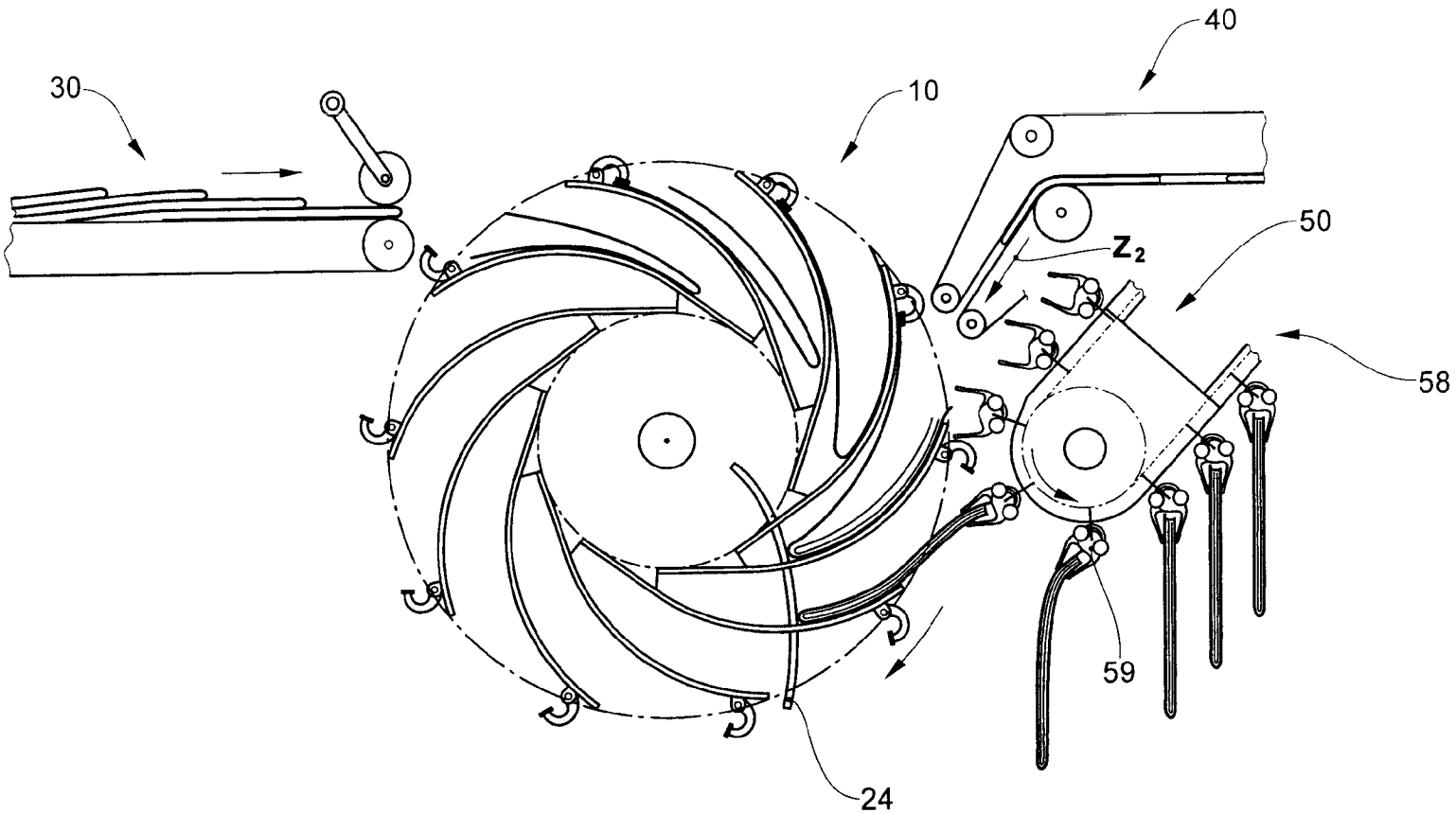

After the object 8 is pushed in, the clamping element 22 is released, with the result that the product 2 can be pushed out of the compartment 12 by the stripping device 24 and can be discharged to the removal device 50. In the present case, the products 2 are deposited on a conveyor belt in an imbricated formation, but it is also possible to transfer them to a gripper conveyor, as shown in FIG. 4.

For adaptation to different formats, the stop element 18 is displaced, for example, in the radial direction (adaptation of the distance a). This makes it possible to always fix the products 2 at the same point, at the preliminary fold 3 here. As a result, the transfer to the removal device 50 can also take place without adaptations. This has advantages, in particular, in the case of transfer to a gripper conveyor, because the control of the gripper movement thus does not have to be adapted to different product positions within the compartment 12 (see FIG. 4).

The compartment 12 changes its depth by displacement of the stop element 18. However, the opening angle of the product 2 does not change to such a pronounced extent as a function of the depth as in the case of systems with radially oriented dividing walls 14, with the result that an undesirable pronounced widening of the product 2 is avoided. The effective opening width d of the compartments 12 which restricts the widening of the product 2 is considerably smaller, on account of the tangential orientation of the dividing walls 14, than the width of the opening 16 as measured in the circumferential direction which would be critical in the case of radially oriented products.

The dividing walls 14 of the circulating system from FIG. 1 are bent counter to the circulating direction, that is to say toward the rotational axis D. Since the products 2 are fixed on the trailing dividing wall 14 of a compartment 12, opening of the product 2 is achieved in a simple way by the curvature of the dividing wall 14 and the inherent rigidity of the product 2.

The dividing walls 14 could also be of straight configuration. Moreover, it is also possible that they do not have complete surfaces, but comprise a plurality of elements which define a supporting face. The front and rear sides of a dividing wall 14 could likewise not be assigned in each case to a compartment 12, but rather each compartment 12 could have separate supporting elements for the leading and the trailing compartment walls. A further variant comprises fastening transport pockets to a conveying means, for example a chain, which is moved along the circulating track, for example guided by rail. In this case, the circulating track could also be a shape other than circular. However, the construction shown in FIG. 1 of the circulating system is particularly simple in structural terms.

Figure 2:
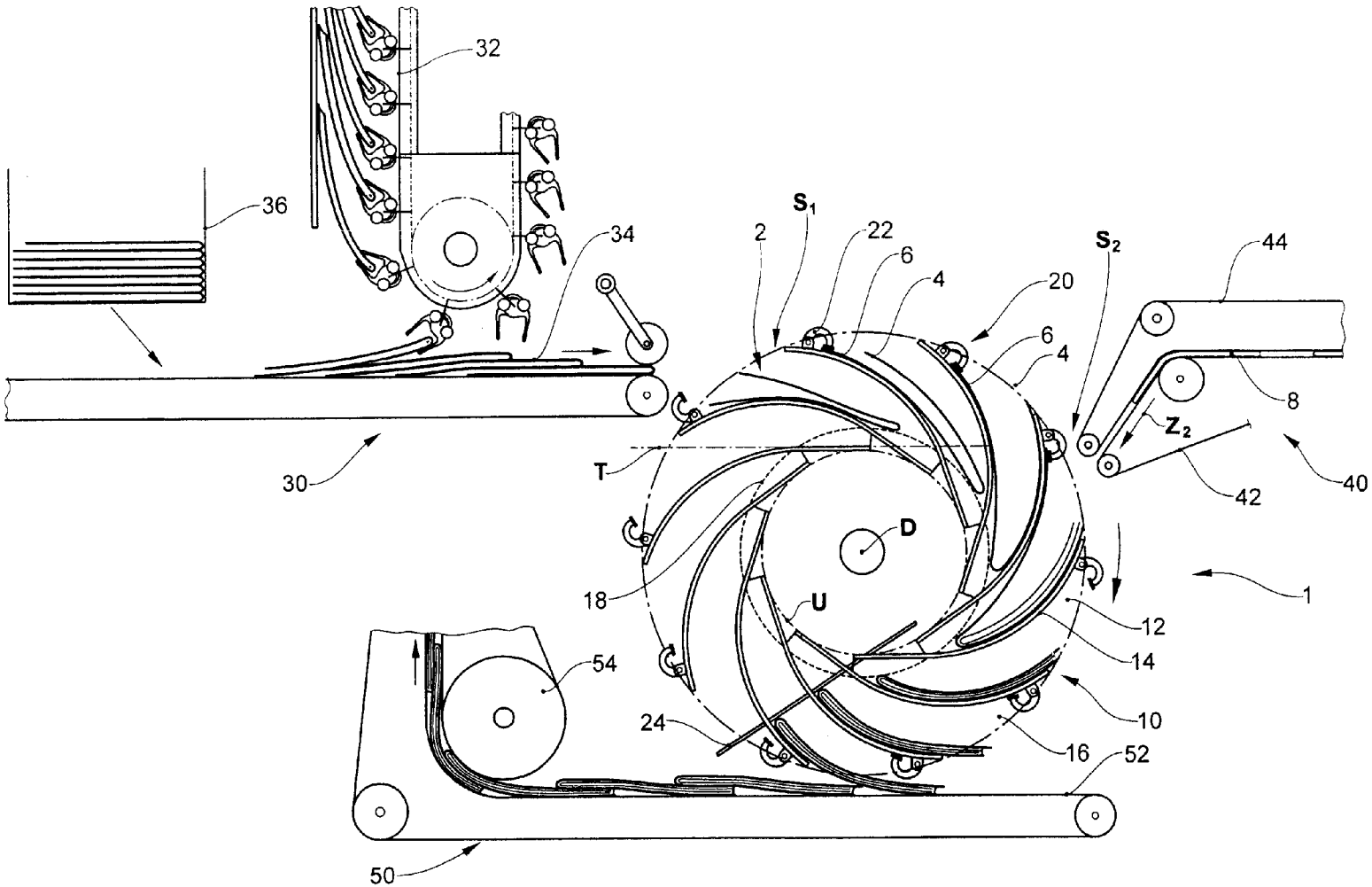
FIGS. 2-4 show an apparatus according to FIG. 1 with different variants of the feed stations and the removal means.

FIG. 2 shows an apparatus 1 according to FIG. 1 with a feed station 30 which receives products 2 optionally online from a gripper conveyor 32, which is connected, for example, to the output of a printing press, or offline from a product store 36. The products 2 are conveyed on a conveyor belt 34 to the feed point S1 and are accelerated in the process, for example.

The feed station 40 outlined in FIG. 2 for the objects 8 to be inserted comprises two conveyor belts 42, 44 which are driven in opposite directions and between which greater or more complex objects 8 can also be received and conveyed. The conveyor belts 42, 44 extend in the region of the feed point S2 in such a way that the conveying direction Z2 of the objects 8 corresponds approximately to the instantaneous orientation of the compartments 12; here, they are inclined obliquely downward. The feed station 40 can be configured, for example, as described in EP-A 1 475 329. An apparatus according to EP-B 1 456 106 can be used to combine and introduce relatively complex objects.

As described above, the removal device 50 comprises a conveyor belt 52, the conveying direction of which in the region of the product discharging means corresponds to the instantaneous conveying direction (circulating direction) of the products 2. The products 2 which are deposited in an imbricated formation can subsequently be received by further conveyors or guided over deflection means 54, for example as described in EP-A 1 411 011.

Figure 3:
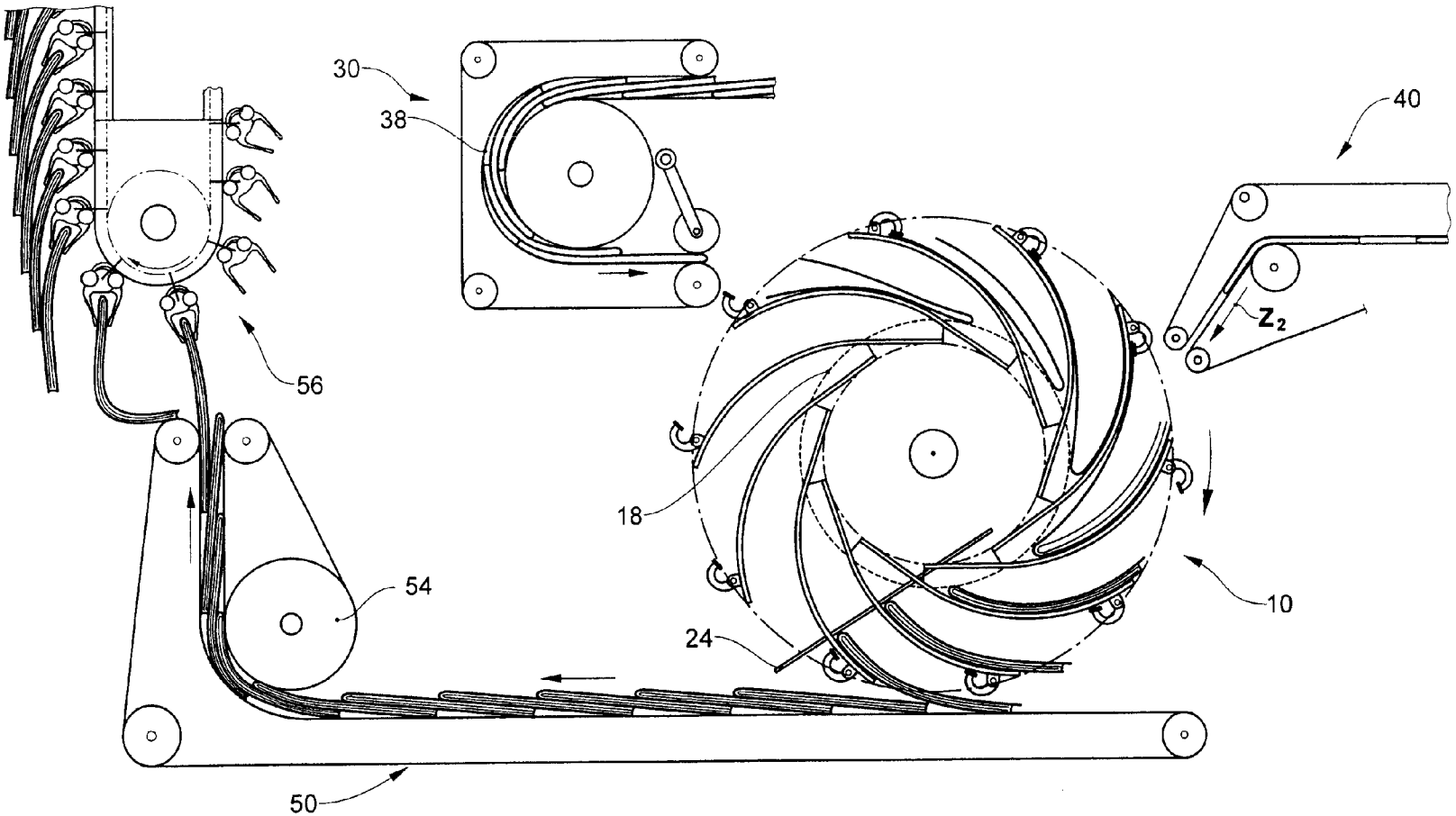

FIG. 3 shows a variant of the arrangement from FIG. 2, in which the conveying direction of the products 2 is reversed in the feed means 30. The imbricated formation of the products 2 is fed above the circulating system 10 counter to the rotational direction in the upper part and is rotated by 180° by a deflection means 38, realized here by two conveyor belts which are deflected in a circular shape and are driven in opposite directions. The products 2 are then introduced into the compartments 12 as described above.

In addition to the components shown in FIG. 2, the removal device 50 which is shown in FIG. 3 comprises a gripper conveyor 56 which accepts the products 2 in a substantially upright position, into which they have been moved by the deflection means 54. The grippers grip the products 2 at the cord or at the folded edge.

FIG. 4 shows a variant, in which the products 2 are accepted from the circulating system 10 directly by a gripper conveyor 58. Here, the products 2 are gripped by the grippers 59 at their open edge which lies opposite the folded edge 5. To this end, they are pushed slightly out of the compartments 12 by a stripping element 24, with the result that the edge projects and can be gripped by the grippers 59. The transfer point is situated to the side of the circulating system 10 at a position, in which the compartments 12 are still oriented upward, with the result that the open product edge is still situated above the folded edge 5. The product 2 is therefore pushed out of the compartment counter to gravity. This makes very precise control of the product movement possible.

For format adaptation, the stripping element 24 can preferably likewise be adjusted, with the result that the product edge to be gripped is always situated at the same position.

The direct acceptance of products 2 by grippers from a circulating system 10 is described in application no. CH 0098/08 which is not a prior publication and to which reference is made here additionally with regard to the design of the circulating system and the control of the grippers.

Figure 5:
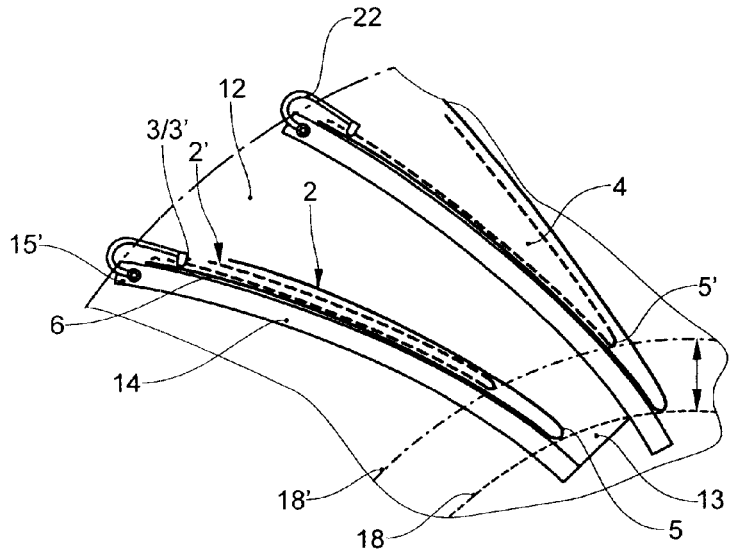
FIGS. 5-7 show different variants of the opening device.
Figure 6:
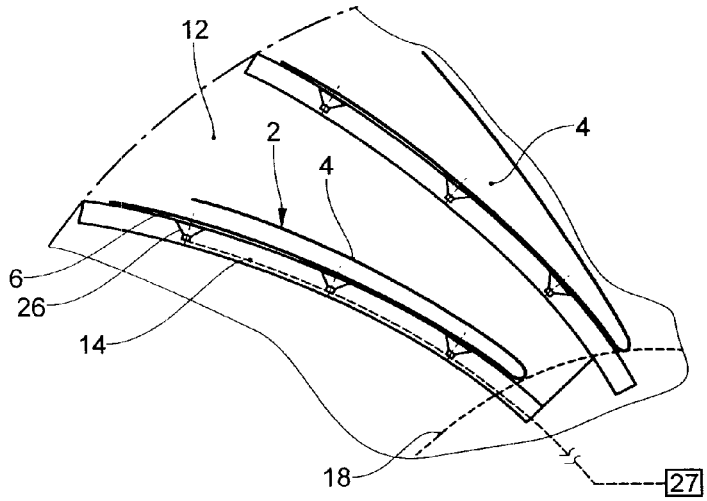

FIGS. 5-7 show different options as to how a product 2 which is introduced into a compartment 12 can be held and opened.

In the example of FIG. 5, a clamping element 22 is situated at the outer edge 15' of the dividing wall 14, which clamping element 22 can be pivoted in a controlled manner relative to the dividing wall 14 and can clamp one of the product parts 6 at its preliminary fold 3 against the dividing wall 14. The products 2 are opened by the compartment 12 changing its orientation by movement along the circulating track U. Movable stop elements 18, against which the folded edge 5 bears during the conveying by the circulating system 10, are arranged in the region of the pocket base 13.

Stop elements 18' are shown using dashed lines, which stop elements 18' are at a greater distance a from the rotational axis D and hold a product 2' of smaller length (folded edge 5') in such a way that its preliminary fold 3' can be gripped by the clamping element 22.

In the example of FIG. 6, nozzles 26 which are connected to a vacuum source 27 are arranged in the dividing wall 14. The product part 6 which trails in the direction of revolution is held on the corresponding compartment wall by vacuum. The product 2 is opened in turn during a change in the orientation of the compartment 12. The vacuum supply can preferably be established and interrupted in a controlled manner, in order not to attract the product 2 by suction until it is introduced completely into the compartment 12, and to release it again at the transfer point. A preliminary fold 3 is not necessary in this variant.

FIG. 7 shows an example, in which the opening operation of a product 2 which is already held at a product part 6 is assisted by additional means. In the present case, the latter are realized by further nozzles 28 which are connected to a compressed air source 29. The nozzles 28 preferably blow air between the two product parts 4, 6, that is to say in the direction of the folded edge 5, with the result that they are raised up from one another. The nozzles 28 are stationary or are moved together with the compartments 12; in the latter case, the compressed air supply can preferably be controlled. Instead of compressed air, mechanical means could also be used to open the product 2, for example an opening blade.

The invention claimed is:

1. An apparatus for inserting flat objects into a folded printed product, comprising:

a circulating system with a plurality of compartments;

wherein the compartments are moveable along a closed circular circulating path about a rotational axis, are delimited by dividing walls in the circulating direction and, along the circumference, have openings for inserting printed products and flat objects into the compartments, a controllable opening device for opening and keeping open printed products which are inserted into the compartments at a first feed point, in such a way that the flat objects can be inserted into the opened folded printed products at a second feed point, wherein the dividing walls, at least in parts thereof, run substantially tangentially or secantially with respect to the circulating path.

2. The apparatus as claimed in claim 1, wherein the circulating path is defined by the path of that point of the dividing walls or bases of the compartments which is at the smallest distance from the rotational axis, and wherein the dividing walls extend tangentially with respect to the circulating track in the immediate vicinity of the compartment base.

3. The apparatus as claimed in claim 2, wherein the dividing walls are bent toward the rotational axis at least in the region which faces away from the compartment base.

4. The apparatus as claimed in claim 1, wherein the openings of the compartments are oriented counter to the circulating direction.

5. The apparatus as claimed in claim 1, wherein the dividing walls are bent counter to the circulating direction.

6. The apparatus as claimed in claim 1, further comprising a feed station for the folded printed products, which feed station is arranged relative to the circulating system in such a way that the printed products are inserted at the first feed point substantially parallel to that dividing wall of the corresponding compartment which follows in the direction of revolution.

7. The apparatus as claimed in claim 6, wherein the feed station is designed to insert the printed products in the circulating direction.

8. The apparatus as claimed in claim 1, wherein the base of the compartments is defined by stop elements which are arranged at a predefined distance from the rotational axis.

9. The apparatus as claimed in claim 8, wherein the distance of the stop elements from the rotational axis is variable for adaptation to different formats.

10. The apparatus as claimed in claim 1, wherein the circulating system is a paddle wheel which can be rotated about the rotational axis.

11. The apparatus as claimed in claim 1, wherein the opening device comprises a controllable clamping element which is capable of fixing one of the product parts of the folded printing product in the compartment.

12. The apparatus as claimed in claim 11, wherein the clamping element is capable of fixing the trailing product part in the circulating direction in the region of its radially outer edge.

13. The apparatus as claimed in claim 1, wherein the opening device is capable of fixing one of the product parts of the folded printed product in the compartment by means of vacuum.

14. The apparatus as claimed in claim 11, wherein the opening device is capable of raising up the unfixed product part from the fixed product part by means of blowing air.

15. The apparatus as claimed in claim 1, further comprising a control apparatus, by way of which the opening device can be controlled as a function of the position of the compartments along the circulating path.

16. The apparatus as claimed in claim 1, further comprising a stationary stripping device which is capable of pushing the printed products with the inserted objects out of the compartments by acting on the folded edge in such a way that the printed products can be accepted and conveyed further by a removal device.

17. The apparatus as claimed in claim 16, wherein the stripping device can be displaced relative to the circulating system for adaptation to different product formats.

18. A method for inserting flat objects into folded printed products, comprising the following steps:

feeding of the printed products at a first feed point to a circulating system with a plurality of compartments which are moved along a circulating path and are delimited in the circulating direction by dividing walls), the dividing walls extending at least in regions substantially tangentially or secantially with respect to the circulating track, and the printed products being fed in a direction which extends substantially parallel to the trailing dividing wall of the compartment when the latter passes the first feed point;

opening of the printed products in the compartments during the movement along the circulating track;

insertion of the flat objects into the opened printed products at a second feed point; and discharging of the printed products with the inserted flat objects out of the circulating system.

19. The method as claimed in claim 18, wherein the flat objects are fed at the second feed point in a direction which extends substantially parallel to the trailing dividing wall of the compartment, when this passes the second feed point, the objects being fed in the circulating direction.

20. The apparatus as claimed in claim 13, wherein the opening device is capable of raising up the unfixed product part from the fixed product part by means of blowing air.

* * * * *